United States Patent [19]

Barnett et al.

[11] Patent Number: 5,013,638

[45] Date of Patent: May 7, 1991

[54] PHOTOGRAPHIC SILVER HALIDE ELEMENT CONTAINING SMALL AMOUNTS OF BROMIDE IONS

[75] Inventors: Anthony M. Barnett, Bushey; David A. Hallbery, Wembley, both of Great Britain

[73] Assignee: Eastman Kodak Company, Rochester, N.Y.

[21] Appl. No.: 418,593

[22] Filed: Oct. 10, 1989

[30] Foreign Application Priority Data

Oct. 18, 1988 [GB] United Kingdom ..... 8824364

[51] Int. Cl.[5] ..... G03C 1/76

[52] U.S. Cl. ..... 430/539; 430/227; 430/523

[58] Field of Search ..... 430/227, 523, 539

[56] References Cited

U.S. PATENT DOCUMENTS

| | | | |
|---|---|---|---|
| 4,460,680 | 7/1984 | Ogawa et al. | 430/539 |
| 4,476,218 | 10/1984 | Ogawa et al. | 430/539 |
| 4,481,284 | 11/1984 | Ogawa et al. | 430/539 |
| 4,596,764 | 6/1986 | Ishimaru | 430/539 |
| 4,608,818 | 4/1985 | Ogawa et al. | 430/539 |

FOREIGN PATENT DOCUMENTS 60-43656 3/1985 Japan .

*Primary Examiner*—Jack P. Brammer

*Attorney, Agent, or Firm*—Alfred P. Lorenzo

[57] ABSTRACT

A photographic donor material is described which comprises silver halide having at least 95% silver chloride, which material also contains a minor amount of bromide ions, an amount of development inhibitor and which has a hydrophilic overcoat layer to retard access of processing solution to the silver halide. The photographic material is useful in a silver salt diffusion transfer process.

8 Claims, 1 Drawing Sheet

PHOTOGRAPHIC SILVER HALIDE ELEMENT CONTAINING SMALL AMOUNTS OF BROMIDE IONS

Figure 1:
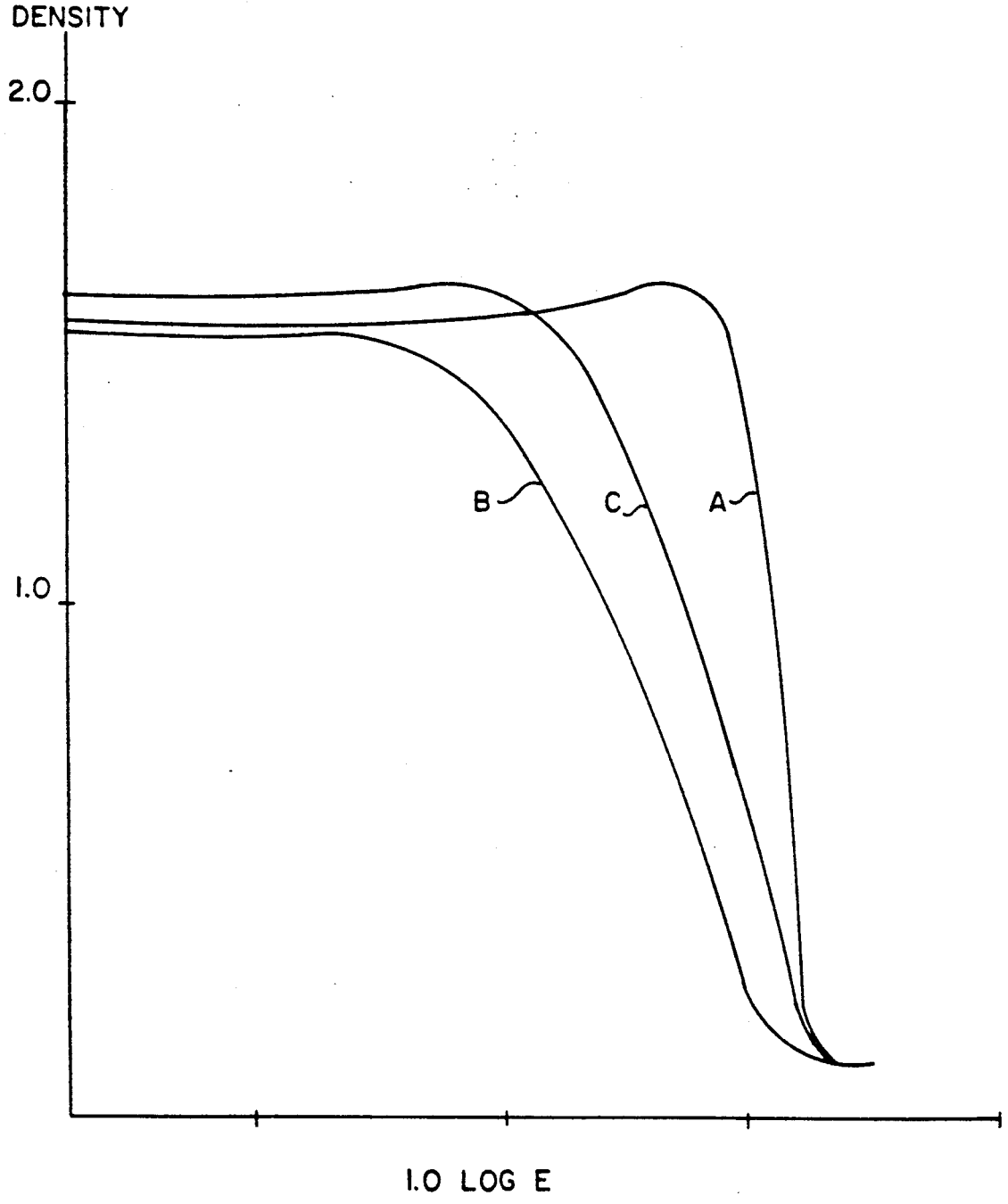

This invention relates to photographic silver halide materials and in particular to photosensitive donor materials for the silver salt diffusion transfer process.

A range of products are commercially available which can all be processed in a universal processing solution containing developer. This is clearly very convenient for the user as a single processing machine and processing solution can be used for all combinations of donor and received materials. Up to now, all the materials available are for applications in the graphic arts field and thus are intended to form images of high contrast.

It would, however, also be desirable to form continuous tone images using the same basic system. Although there have been proposals for continuous tone materials in the diffusion transfer field, many have a rather complex structure and are therefore difficult or expensive to manufacture or cannot be used in a universal developer system.

The present invention seeks to provide a photosensitive donor material for the silver salt diffusion transfer process that is capable of forming continuous tone images in a system designed for high contrast images.

According to the present invention there is provided a photosensitive photographic material comprising a support bearing a photosensitive silver halide emulsion layer comprising at least 95% silver chloride characterised in that:

(a) the emulsion contains from 0.002 to 0.05 mol of bromide ions per mol of silver halide, (b) the material contains in or adjacent the emulsion layer from 0.25 to 1.8 g of a development inhibitor per mole of silver halide, and (c) the material comprises a hydrophilic colloid layer over the emulsion layer its thickness and composition being such that access of the processing solution to the silver halide layer is retarded.

FIG. 1 illustrates sensitometric curves of contrast values from examples of this invention.

The silver halide of the photosensitive emulsion may contain up to 5% silver iodide on the surface of the grains but is preferably free from bromide ions (prior to said addition of bromide ions). Preferably the silver halide is substantially pure chloride.

The bromide ions are preferably added to the emulsion after it is fully formed and before coating. Preferably 0.005 to 0.020 mol is added per mol of silver halide, as, for example, potassium bromide.

The development inhibitor may be of any type which is described for example in U.S. Pat. Nos. 3,227,554; 3,620,747; 3,703,375 and 4,248,962. Other patents and applications describing ways in which couplers which release development inhibitors can be employed include U.S. Pat. No. 3,892,572; U.K. Patent No. 1,460,991 and German OLS No. 2,516,982.

These disclosed DIR couplers include nitrogen-containing heterocyclic compounds and DIR compounds containing mercapto groups. Specific examples of suitable released development inhibitors are methyl-benzothiazolium iodide and 1-(3-acetamidophenyl)-5-mercaptotetrazole. The amount of development inhibitor to be used is preferably from 0.8 g to 1.3 g per mol of silver halide.

The hydrophilic colloid layer is such that the inward diffusion of processing solution is inhibited. If the layer is composed of a less permeable material, e.g. poly (methyl methacrylate) and its copolymers with methacrylic acid or poly (acrylamide) possibly crosslinked with N,N-methylenebis-acrylamide, its thickness can be comparatively small while if composed of a relatively more permeable material, e.g. gelatin or gelatin derivatives, its thickness should be greater. Preferably the layer comprises gelatin and its thickness preferably corresponds to a coating weight of between 1 and 10 $g/m^2$, more preferably from 4.0 to 7.0 $g/m^2$.

The donor material may have incorporated therein developing agent, e.g. hydroquinone. However the preferred materials are free of developing agent.

The photographic donor material may comprise a support, silver halide emulsions, chemical and spectral sensitisers, hardeners and other additives known in the art, for example as described in Research Disclosure, Dec. 1978, Item 1743, published by Industrial Opportunities Ltd, The Old Harbourmaster's, 8 North Street, Emsworth, Hants PO10 7DD, UK.

The following examples are included for a better understanding of the invention.

EXAMPLE 1

Invention

A silver chloride emulsion (grain size 0.34 μm) was prepared, and to this 1.5 g KBr per mole of AgCl was added. To this an orthochromatic sensitizing dye (peak absorbtion of 509 nm) was added at 1 mg per mole AgCl.

To this, 1.22 g benzothiazolium iodide was added, followed by sufficient gelatin to enable a coating to be made (typically between 4–9%).

This was then coated onto a resin coated paper support to give a silver laydown of 0.6 $g/m^2$. Over this, a supercoat containing gelatin was coated to give a gelatin laydown of 6 $g/m^2$. During coating a hardening agent, formaldehyde, was added such that the final coating, when immersed in a processing solution, such as PMTII Activator solution, would swell at between 10 μm and 40 μm. This coating was exposed to a step wedge (incremental density 0.1) and processed using PMTII activator in a suitable diffusion transfer processor (e.g. Kodak Imagemate 43DT), and laminated to a receiver comprising NiS nuclei for a duration of 60s lamination time.

The image on the receiver gave the sensitometric curve shown in FIG. 1, Curve B, and had a neutral black image tone.

This can be compared to the Curve obtained by processing a donor material as above but without the bromide ion and benzothiazolium chloride additions and with a gelatin supercoat at 0.8 $g/m^2$ gelatin under similar conditions, which is shown in FIG. 1, Curve A. Curve B clearly has the lower contrast but similar D max and D min compared to Curve A.

EXAMPLE 2

Comparative

A coating was made as in Example 1 but with the following composition:

KBr: 7.5 g per mol AgCl

Benzothiazolium iodide: 1.22 g per mol AgCl

Supercoat laydown: 6 $g//m^2$

This, when coated and processed as in Example 1, gave a sensitometric curve similar to Curve B in FIG. 1, but the image having a reddish brown tone, especially in the toe region of the curve, indicating too much KBr hs been added.

EXAMPLE 3

Comparative

A coating was made as in Example 1 but with the following composition:

KBr: 1.5 g per mol AgCl

Benzothiazolium iodide: 2.5 g per mol AgCl

Supercoat laydown: 6 g/m$^2$

This, when coated and processed as in Example 1, resulted in no image transfer to the receiver, indicating too much benzothiazolium iodide has been added.

EXAMPLE 4

Comparative

A coating was made as in Example 1 but with the following composition:

KBr: 1.5 g per mol AgCl

Benzothiazolium iodide: 1.22 g per mol AgCl

Supercoat laydown: 0.8 g/m$^2$

This, when coated and processed as in Example 1, gave the sensitometric curve shown in FIG. 1, Curve C, which although lower contrast than that of Curve A was not as low as that of Example 1, Curve B, indicating the necessity of a processing-retarding supercoat.

The invention has been described in detail with reference to preferred embodiments thereof but it will be understood that variations and modifications can be effected within the spirit and scope of the invention.

What is claimed is:

1. A photographic element that is useful as a donor element in forming continuous tone images by a silver salt diffusion transfer process, said photographic element comprising:

(1) a support, (2) a photosensitive silver halide emulsion layer comprising silver halide grains, said grains being at least 95% silver chloride, said emulsion layer containing from 0.002 to 0.05 mole of bromide ions per mole of silver halide; and (3) a hydrophilic colloid layer overlying said emulsion layer which serves to retard access of a processing solutions to said emulsion layer, said hydrophilic colloid layer having a dry weight of from 1 to 10 grams per square meter;

said element including a development inhibitor in or adjacent to said emulsion layer in an amount of from 0.25 to 1.8 grams per mole of silver halide.

2. A photographic element as claimed in claim 1 wherein said silver halide grains are substantially pure silver chloride.

3. A photographic element as claimed in claim 1 wherein said emulsion layer containsd 0.005 to 0.02 mole of bromide ions per mole of silver halide.

4. A photographic element as claimed in claim 1 wherein said development inhibitor is benzothiazolium iodide.

5. A photographic element as claimed in claim 1 wherein said development inhibitor is 3-acetamido-4-phenyl-5-mercaptotetrazole.

6. A photographic element as claimed in claim 1 wherein said development inhibitor is present in said element in an amount of from 0.8 to 1.3 grams per mole of silver halide.

7. A photographic element as claimed in claim 1 wherein the hydrophilic colloid in said hydrophilic colloid layer is gelatin.

8. A photographic element as claimed in claim 1 wherein said hydrophilic colloid layer contains gelatin in an amount of from 4 to 7 grams per square meter.

* * * * *